United States Patent [19]

Panosh

[11] 3,971,560

[45] July 27, 1976

[54] FLUORESCENT TABLE TENNIS ASSEMBLY

[75] Inventor: James L. Panosh, Fullerton, Calif.

[73] Assignee: Alpha Nova Development Corporation, Santa Ana, Calif.

[22] Filed: Mar. 21, 1975

[21] Appl. No.: 560,691

[52] U.S. Cl. ..... 273/30; 273/DIG. 24

[51] Int. Cl.[2] ..... A63B 69/36

[58] Field of Search ..... 273/30, 101, DIG. 24, 273/186 C, 186 A, 183 E, 183 D, 31, 176 A, 29; 250/336, 373, 372

[56] References Cited

UNITED STATES PATENTS

| | | | |
|---|---|---|---|
| 2,050,402 | 8/1936 | Walsh | 273/62 |
| 2,387,512 | 10/1945 | Hilberg | 250/483 X |
| 3,464,703 | 9/1969 | Vallas | 273/176 A |
| 3,477,717 | 11/1969 | Clark | 273/30 |
| 3,649,028 | 3/1972 | Worrell | 273/186 A |
| 3,649,029 | 3/1972 | Worrell | 273/186 C |
| 3,709,495 | 1/1973 | Krombein | 273/101 |
| 3,717,343 | 2/1973 | Hartford | 273/30 |

*Primary Examiner*—Richard C. Pinkham
*Assistant Examiner*—J. Brown

[57] ABSTRACT

A table tennis assembly including a table having a flat upper surface, a transversely disposed net that divides the surface into two playing areas, a ball, and a pair of paddles that include ball striking surface that is characterized by at least the periphery of the flat upper surface, the net, the ball and the striking surfaces of the paddles having a fluorescent material thereon. The fluorescent material is selected from a group that comprises organic compounds, dyes, and inorganic compounds that emit light visible to the human eye when exposed to electromagnetic radiation in the infra-red or ultra-violet range. When the assembly that includes the fluorescent material is exposed to radiation to which the fluorescent material is responsive, the table, net, ball and paddles are illuminated to the extent that table tennis may be played in the dark. The table tennis assembly may be either originally manufactured to include the fluorescent material, or a kit may be provided to transform a conventional table tennis assembly to one which in combination with a source of black light, preferably ultra-violet radiation, may be used to play table tennis in the dark.

2 Claims, 4 Drawing Figures

FLUORESCENT TABLE TENNIS ASSEMBLY

BACKGROUND OF THE INVENTION

1. Field of the Invention

Fluorescent Table Tennis Assembly.

2. Description of the Prior Art

Table tennis as is well known has become increasingly popular in the past few years, and many players have obtained a high proficiency in playing the game. To provide challenge to such players, as well as players that are seeking a novel form of entertainment, I have developed the present invention which permits the playing of table tennis in the dark.

A major object of the present invention is to provide a table tennis assembly that in conjunction with a source of black light, either infra-red or ultra-violet radiation, is illuminated to the extent that it may be used to play table tennis in the dark.

Another object of the invention is to supply a kit that permits a conventional table tennis assembly to be modified so that when the assembly is exposed to a source of black light the assembly becomes illuminated to the extent that it may be used to play table tennis in the dark.

A still further object of the invention is to supply a game that has a high degree of player appeal and is ideally suited for use in taverns and the like in lieu of pool tables.

SUMMARY OF THE INVENTION

The conventional table tennis assembly includes a table having a flat rectangular surface that is subdivided by a transverse net into two playing areas. The assembly further includes a hollow resilient ball and two paddles, with each paddle having a ball striking surface and a handle projecting therefrom.

In a first form of the invention, the assembly when manufactured would have a fluorescent material impregnated into the material defining the net and ball, and a film of the fluorescent material covering at least a part of the ball striking surfaces of the paddles. The peripheral edge portions of the table would have a margin of the fluorescent material overlying the same. When this first form of the assembly is exposed to ultra-violet or infra-red radiation that will energize the fluorescent material to emit light visible to the human eye, the assembly is illuminated to the extent that table tennis may be played in the dark.

In a second form of the invention the same type balls and paddles are used as in the first form. A roll of tape is provided that has the fluorescent material incorporated thereinto. The tape is cut into lengths and adhered to at least the side edges and ends of the table on which the two playing surfaces are defined. The net has strips of the tape adhered to the upper and lower edges thereof as well as the end edges of the net. When the second form of the invention is subjected to radiation that will energize the fluorescent material, the table, net, ball and paddles are illuminated to the extent that table tennis may be played in the dark.

DESCRIPTION OF THE PREFERRED EMBODIMENT

Figure 1:
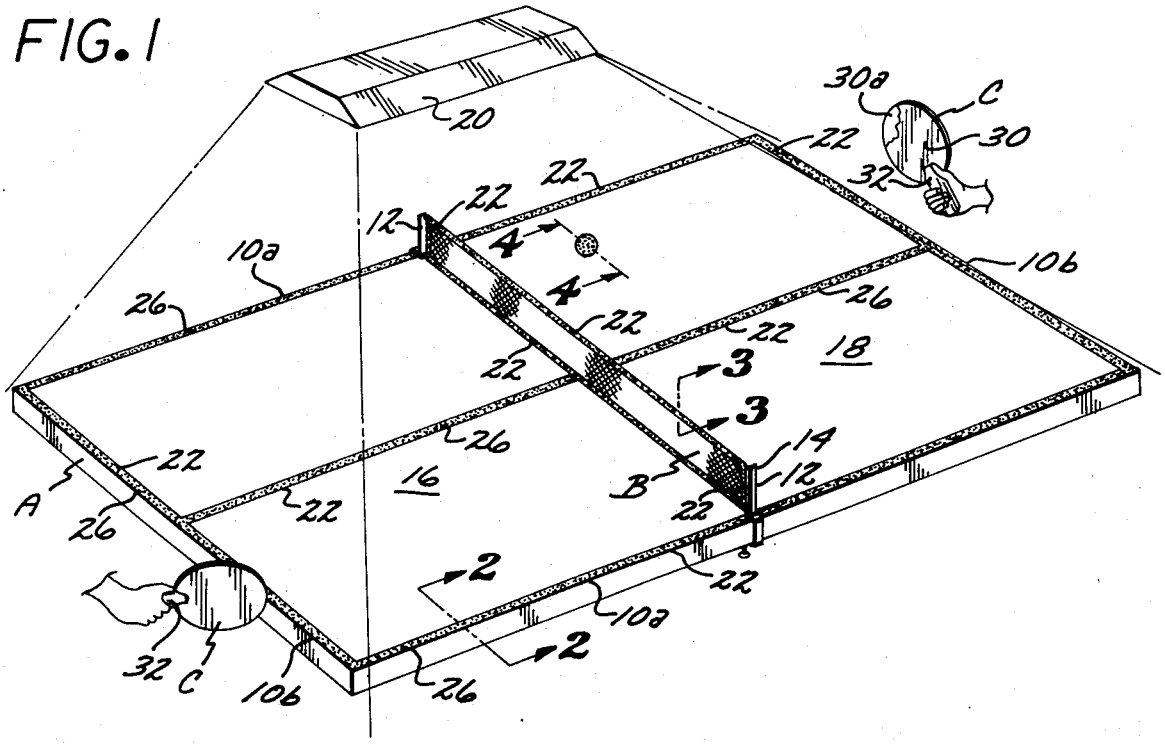
FIG. 1 is a perspective view of a table tennis assembly together with a source of infra-red or ultra-violet radiation, with the edges of the upper surface of the table and the edges of the net being bounded by tape that carries a fluorescent material that emits visible light when subjected to either said infra-red or ultra-violet radiation, and the ball and striking surfaces of the paddles likewise carrying said fluorescent material to be visible in the dark when subjected to the radiation.
Figure 2:
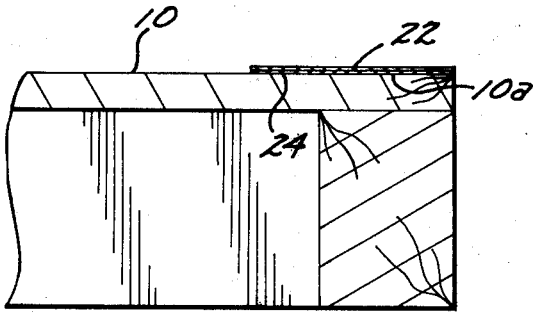
FIG. 2 is a fragmentary transverse cross sectional view of the table taken on the line 2—2 of FIG. 1.

The form of the invention shown in FIG. 1 includes a rectangular table A that has a flat upper surface. The flat upper surface has side edge portions 10*a* and end edge portions 10*b*. An elongate net B is provided that is formed from a net-like material that has cords 14 on the top and bottom thereof. The cords 14 are secured to uprights 12 situated at the center of the table, with the net subdividing the table into first and second playing surfaces 16 and 18.

An electrically operated source 20 of black light is provided, preferably ultra-violet, although infra-red radiation may be used. A roll of tape 22 is provided which preferably has a coating of a pressure sensitive adhesive 24 on one side thereof and a film of a fluorescent material 26 on the opposite side. The fluorescent material 26 must be one that is energized by the black light to emit light visible to the human eye. Various fluorescent materials 26 may be used. When the black light is ultra-violet radiation, the fluorescent material 26 may be zinc silicate, calcium tungstate, cadmium borate and the like. The visible light emitted by zinc silicate is green, when the zinc silicate is subjected to ultra-violet radiation. Calcium tungstate emits blue light and cadmium borate pink light when subjected to ultra-violet radiation. Various materials 26 that are excited to emit visible light when subjected to ultra-violet or infra-red radiation are described in a book entitled "Fluorochemistry" by Jack De Ment, 1945 edition, published by Chemical Publishing Company, Inc., Brooklyn, N.Y.

Figure 3:
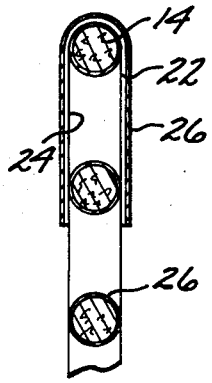
FIG. 3 is a fragmentary transverse cross sectional view of the net taken on the line 3—3 of FIG. 1.
Figure 4:
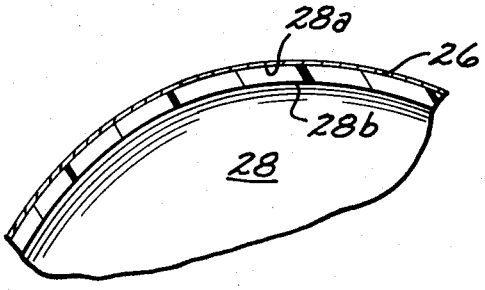
FIG. 4 is a fragmentary transverse cross sectional view of the ball taken on the line 4—4 of FIG. 1.

The tape 22 is cut into lengths and bonded to the table edge portions 10*a* and 10*b* as well as to the upper and lower longitudinal edge portions and end edge portions of the net B as shown in FIG. 1. Should it be desired a length of the tape 22 may be extended longitudinally along the center of surface 10 to subdivide the playing areas 16 to 18 to simulate a conventional tennis court surface. The body of the tape 22 may be plastic, cloth or the like that is sufficiently pliable as to be foldable as shown in FIG. 3. Likewise the tape 22 may be either transparent or opaque. If the tape 22 is opaque, the fluorescent material 26 must be adhered by a suitable material such as a liquid polymerizable resin to the surface of the tape.

The ball 28 may have fluorescent material 26 adhered to the exterior surface thereof by a carrier therefor such as a liquid polymerizable resin. The resin when it polymerizes to the solid form holds the fluorescent material in place on the ball 28. The same results may be attained by adhereing the fluorescent material 26 to the interior surface 28*b* of the ball 28, or incorporating the fluorescent material into the resilient plastic material that defines the body of the ball.

The striking surface 30 of the paddle C is at least partially covered with a film 30*a* of fluorescent material 26 that is adhered thereto by use of a suitable carrier in the same manner as on the ball 28.

When the invention is to be incorporated into a new table tennis assembly, the edge portions 10*a* and 10*b* are covered by a margin of fluorescent material 26 in a suitable carrier, such as a polymerizable liquid resin, and the tape 22 may be eliminated. The tape 22 may be eliminated from net C by soaking the fabric defining the net in a solution containing the fluorescent material 26. Such a net C will have the entire body thereof fluoresce when exposed to suitable infra-red or ultra-violet radiation.

A variety of fluorescent materials 26 may be used so that different components of the table tennis assembly will be illuminated by different colored light when the fluorescent materials are exposed to the black light radiation.

The use and operation of the invention has been described previously in detail and need not be repeated.

I claim:

1. In combination with a source of ultra violet light, a tennis table assembly that may be used in the dark that includes a flat, horizontal, rectangular surface, a transverse vertically extending net that divides said surface into first and second portions, a resilient hollow ball, and a pair of paddles that define striking surfaces thereon, said table tennis assembly being characterized by:

a. first means that outline the outer boundary of said surface, said first means fluorescing and being visible when exposed to said ultra violet light;

b. second means that outline the edges of said net, said second means fluorescing and being visible when exposed to said ultra violet light;

c. third means carried on said ball, said third means fluorescing and being visible when exposed to said ultra violet light; and d. fourth means that cover said striking surface, said fourth means fluorescing and being visible when exposed to said ultra violet light, and said table tennis assembly capable of being used in the dark when exposed to said ultra violet light due to the boundary of said playing surface, the edges of said net, said ball, and said striking surfaces being visible to the players using said assembly.

2. The combination as defined in claim 1 in which said first, second, third and fourth means fluoresce to different colors when exposed to said ultra violet light.

* * * * *